US006269849B1

(12) United States Patent
Fields, Jr.

(10) Patent No.: US 6,269,849 B1
(45) Date of Patent: Aug. 7, 2001

(54) FILLING MACHINE FOR SANDBAGS AND OTHER CONTAINERS

(76) Inventor: Robert E Fields, Jr., 31 Kennington Dr., Pensacola, FL (US) 32507

( * ) Notice: Subject to any disclaimer, the term of this patent is extended or adjusted under 35 U.S.C. 154(b) by 0 days.

(21) Appl. No.: 09/532,571

(22) Filed: Mar. 22, 2000

(51) Int. Cl.[7] ..... B65B 1/04

(52) U.S. Cl. ..... 141/166; 141/114; 141/391; 141/316

(58) Field of Search ..... 141/391, 114, 141/313–316, 166, 231

(56) References Cited

U.S. PATENT DOCUMENTS

| | | | | |
|---|---|---|---|---|
| 4,044,921 | * | 8/1977 | Caverly | 222/74 |
| 4,184,522 | | 1/1980 | Waite . | |
| 4,432,186 | | 2/1984 | McGregor et al. . | |
| 4,763,702 | | 8/1988 | High Jr. et al. . | |
| 5,215,127 | | 6/1993 | Bergeron | 141/10 |
| 5,417,261 | | 5/1995 | Kanzler et al. | 141/313 |
| 5,437,318 | | 8/1995 | Kanzler . | |
| 5,752,367 | | 5/1998 | Ver Mehren | 53/473 |
| 5,806,576 | | 9/1998 | Sutherlin | 141/314 |
| 5,873,396 | | 2/1999 | Biebrach et al. . | |

* cited by examiner

*Primary Examiner*—Steven O. Douglas

(57) ABSTRACT

A semi-automatic fixed or portable machine for the packaging of sand or other granular materials in various containers is disclosed. The machine is comprised of a frame or support which supports and retains a fixed upper feed hopper to receive and store the material to be packaged, a reciprocating rolling drawer assembly to distribute the material to be packaged alternately to seated operator stations at each end, the drawer assembly consisting of flow-through compartments to allow the packaging materials to pass through and into discharge chutes as the rolling drawer assembly is being automatically positioned properly over each final exit chute. The drawer assembly is fitted with an upper and lower friction pan to reduce wear. A plurality of discharge chutes onto which the operator may attach easily suspended bags is also supported. Each discharge chute is configured in such a manner as to facilitate one-hand filling of bags. Directly under each discharge chute is a rotating support/ejector plate apparatus to automatically remove filled containers. The rolling drawer assembly and the upper and lower friction pans may be constructed with removable and replaceable wear bars to facilitate maintenance and ensure longevity. The machine may be operated by either one or two persons with minimal regard to their size or strength and the speed of reciprocation of the rolling drawer assembly may be controlled to match the manual dexterity of the operators. Speed and ease of operation, economy of construction, reduced operator fatigue and ease of maintenance are emphasized.

3 Claims, 6 Drawing Sheets

FILLING MACHINE FOR SANDBAGS AND OTHER CONTAINERS

BACKGROUND

1. Field of the Invention

This invention relates generally to an improved semi-automated apparatus for the filling of bags or other containers with sand or other materials amenable to packaging and a method for the operation of the apparatus.

2. Background of the Invention

From its first manufacture and availability the shovel remains the prime tool for use in filling containers of many sizes with such materials as sand for protection from flooding, as well as for other loose and granular materials normally loose packaged in bags, sacks and boxes. Except for its almost universal availability, economy and portability, the shovel is also the least efficient method of bagging sand in times of emergency when large quantities of sandbags are required in a short period of time.

With modern mechanization many machines for this purpose have been patented and manufactured, all designed to do basically only one thing, fill a bag. Few of the inventors of those machines have exhibited any concern whatsoever for operator convenience, safety, comfort or fatigue. Few innovations have been presented in those areas and too many are overly complicated, difficult to operate and maintain and expensive to manufacture. Presented herein is an easy to manufacture, simple in operation, fast, safe and uncomplicated apparatus wherein the operators are seated in a spacious work area and are able to concentrate on the prime function of filling a container while others remove them from the operators' area, therefore allowing each operator to more rapidly present another bag to the apparatus, thus increasing production in a generally critical situation.

DESCRIPTION OF PRIOR ART

REFERENCES CITED

| U.S. Pat. Nos. | | |
|---|---|---|
| 5,215,127 | June 1, 1993 | Bergeron |
| 5,417,261 | May 23, 1995 | Kanzler-Eiler (gravity) |
| 5,437,318 | August 1, 1995 | Kanzler-Eiler (motorized) |
| 5,752,367 | May 19, 1998 | VerMehren |
| 5,806,576 | September 15, 1998 | Sutherlin |

In U.S. Pat. No. 5,752,367 to VerMehren issued May 19, 1998, a reciprocating drawer feeding two filling stations is described which requires the use of complicated gravity operated trap doors, a constantly reversing motor, gears and racks and dependent upon limit or proximity switches which require timers or other delay mechanisms with attendant complicated electrical circuitry to control the movement. The overall configuration of that machine restricts upper receiving and storage hopper size, thereby reducing the capability of continuous operation. As with virtually all bag filling machines on the market this one also requires that the operators be standing. An additional disadvantage is that each operator must work around a support post of the apparatus which presents another impediment to comfort, ease and speed. The VerMehren patent's alternate embodiment of a generally circular feed requires eight trap doors, unnecessarily complicating a mechanism that must operate in a gritty and highly abrasive application and increasing both the expense and potential for breakdown.

The U.S. Pat. No. 5,215,127 to Bergeron issued Jun. 1, 1993, a multiple loading chute circular configuration, requires that the operators be standing with the added disadvantage of a required synchronization of the efforts of multiple operators. It would also appear that the machine must have an operator at each of the 12 stations at all times of operation to capture the falling material being distributed automatically to each chute in turn from a hopper at the top of the apparatus. With the rotary feed head each operator whose bag has just been filled must wait until material has fallen down every other operator's chute before material falls down again to that operator.

The final exit chutes of both of these machines require that both of the operators' hands be used to hold the bags onto the discharge chutes while filling them and there is apparently no provision for wear, which will be considerable in such a gritty environment. The Bergeron machine's upper feed hopper is exceptionally small and very high relative to the other available machines, thereby requiring the use of a conveyor system rather than the more commonly available front end loader.

The Kanzler-Eiler U.S. Pat. No. 5,417,261 issued May 23,1995 and the Kanzler-Eiler U.S. Pat. No. 5,437,318 issued Aug. 1, 1995 appear to differ mainly in the addition of a motorized auger in the hopper to better distribute the filling material to the multiple exit chutes on the bottom of the machine. While the apparatus can accommodate up to four operators, in pratice these operators must back away from their operating position, turn around and hand off their filled bag. The operators must stand on only one foot while frequently using the other foot to depress a spring return pedal to control the amount of sand falling into their container, apparently the only method of controlling filling volume or weight. There is no automatic filled container removal.

Because of the configuration of the apparatus each operator must work shoulder to shoulder with others, heads frequently jammed against the hopper to be able to reach under it to the discharge chute to attach a bag, which must be held onto the exit chute with both hands while filling.

In U.S. Pat. No. 5,806,576 to Sutherlin issued Sep. 15, 1998, bags are held onto a plurality of discharge chutes with air cylinder clamps and removable collars but the bags must each be attached to a removable collar prior to being inserted into multiple holes and the hydraulic holding apparatus activated. All of the mounted bags are then filled essentially at once. Then all of the bags must be removed individually before loading another set of bag and collar assemblies. It appears that rapid production would difficult because of the complications of operation and construction of such a machine would be unduly complicated and expensive.

None of the above machines appear to have any provision for automatic filled bag removal. Each operator must remove his/her own filled bag from the filling station and hand it off to someone or place it somewhere. All apparently lack any mechanism for controlling the volume and therefore the weight of the filling material and all appear to require standing operators with faces mashed against the machine. None have any apparent provision for wear and most present a crowded work area with a high fatigue potential. At least one other machine is designed to be mounted on a dump truck thus tying up a valuable resource for the duration of the bag filling operation. Some machines require squatting to operate the bag filling mechanism, a very uncomfortable position. Several machines require that the operator use one hand to operate a chute opening handle thus increasing the risk that the bag will slip off the chute while filling and spill some or all of its contents.

OBJECTS AND ADVANTAGES

The apparatus described herein relates to a device for the filling of bags, generally sandbags, and other containers which overcomes many of the faults of the aforementioned patents and others. The upper hopper's configuration virtually doubles the storage area of a single chute hopper, friction pans drastically reduce wear on hard to service areas, replaceable wear bars simplify maintenance, the rolling drawer assembly design facilitates the deposit of a uniform amount and therefore weight of filling material into the containers. Additionally, the motion of that unit with unrestricted flow-through compartments automatically receives and drops filling material relatively gradually instead of all at once and therefore minimizes any clogging of the final exit chute. Bags are held on with only one of an operator's hands instead of requiring two so that the operator may both hold a bag onto the chute with one hand while reaching for a replacement bag with the other thereby increasing the speed of filling many bags in an emergency situation. Once a bag has been filled, simply turning it loose starts a gravity operated action of the rotating bag support/ejector plate which immediately clears the operator's work area of the just filled bag so that another bag already in the operator's other hand may be positioned for filling. Cycle times are increased and therefore the production is also. Operators are comfortably seated and working in a spacious area and operator fatigue is minimal. Physical strength of operators is not a factor.

DRAWING FIGURES

DRAWING REFERENCE NUMBERS USED

Figure 1:
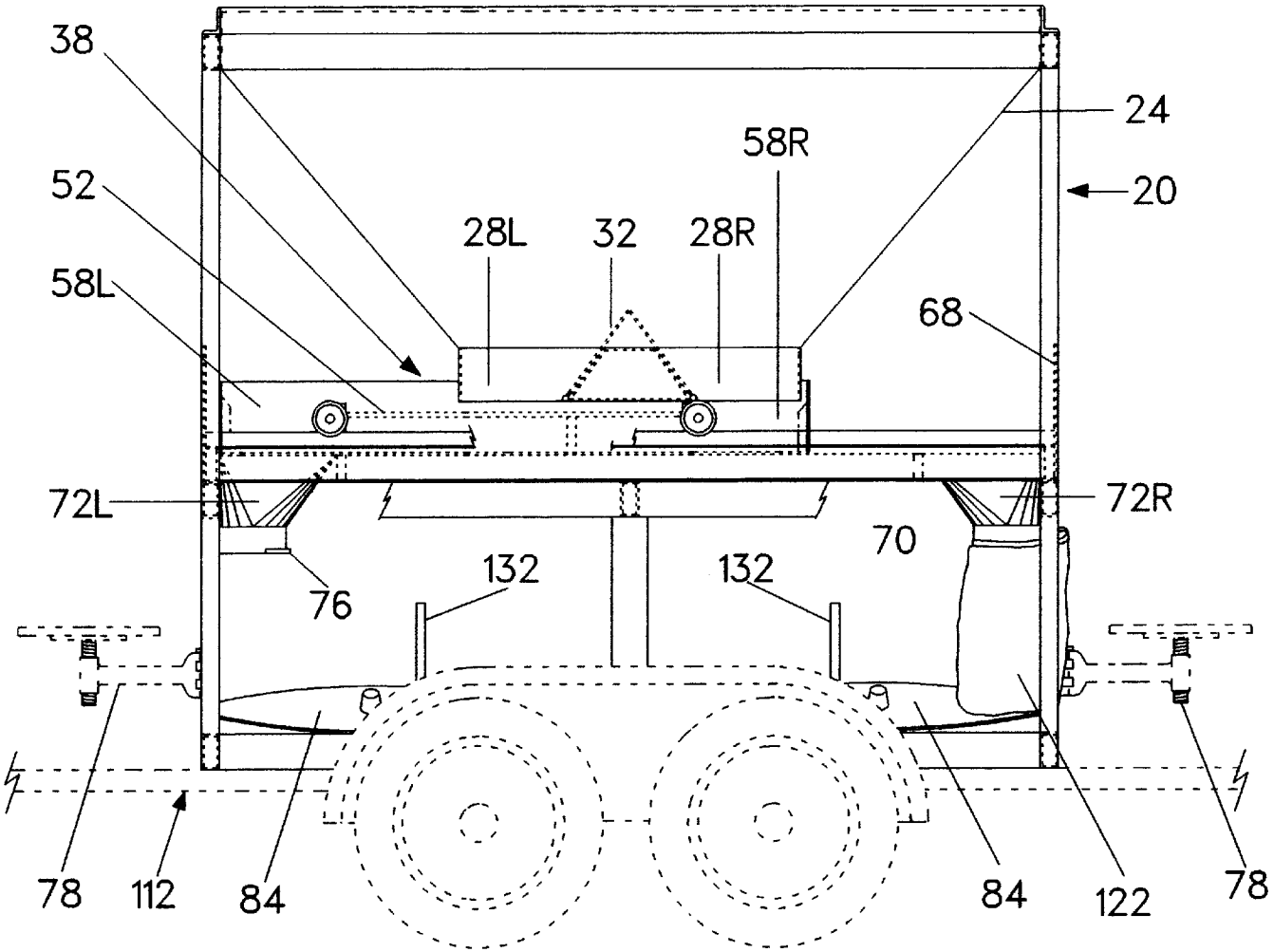
FIG. 1 is a front elevation view of the preferred embodiment of the apparatus as mounted on a commercially available trailer.

20 Frame assembly
24 Dual chute hopper
28L Left hopper chute
28R Right hopper chute
30 Center chute partition
32 Flip-flop plate
38 Rolling drawer assembly
46 Replaceable wear bar
48 Center section cover plate
50 Sand
52 Upper friction pan
58L Left flow-through compartment
58R Right flow-through compartment
60 End safety plate
62 V-groove wheel
64 Inverted angle iron track
66 Track support I-beam
68 Safety stop plate
70 Lower friction pan
72L Left exit chute
72R Right exit chute
76 Bag retaining lug bar
78 Adjustable seat
84 Rotating support/ejector plate
86 Bearing
88 Bearing cover
90 Bearing post
92 Upper horizontal arm
94 Lower horizontal arm
96 Vertical lever arm
98 Rod end bearing
100 Rotating drive bar
102 Electric motor
104 Gear reducer
106 Reducer shaft
110 Standoff block
112 Trailer
122 Sandbag
124 Drawer lift preventer
126 Track cover mount
128 Safety plate mount
130 Floor mount pad
132 Container stop plate

SUMMARY OF THE INVENTION

A portable or fixed apparatus and method for the rapid and easy filling of bags and other containers with predetermined quantities of sand or other granular filling material and with reduced machine wear, maintenance and operator effort.

DESCRIPTION OF FIGURES 1–6

Referring to FIG. 1, a semi-automatic sandbag filling machine is shown in front view as mounted on a commercially available trailer 112 with one container 122, in this illustration a sandbag, mounted onto the right exit chute 72R and resting on the rotating container support/ejector platform 84, approximately one quarter disk rotation away from the container stop plate 132.

The apparatus consists of a frame assembly 20 supporting an upper dual chute receiving and storage hopper 24, dual chutes 28L & 28R configured therein, a rolling drawer assembly 38 which alternately is rolled to and positioned over the opposing final exit chutes 72L & 72R. When positioned as in FIG. 1 over the left final exit chute 72L the left flow-through compartment 58L will drop its load of filling material into a bag held onto the final exit chute 72L by the rear lug bar 76 and one hand of that position's operator. Simultaneously, the right flow-through compartment 58R of the drawer assembly 38 is positioned directly under the right hopper chute 28R to receive a load of filling material, to be constrained within that flow-through compartment 58R by a like filling material held in the upper friction pan 52 portion of the rolling drawer assembly. A lower friction pan 70 is positioned within, and supported by, the flanges of two laterally positioned track support I-beams which also support attached dual inverted-V angle iron tracks 64 supporting the V-groove wheels 62 of the rolling drawer assembly 38.

While being filled, a bag or other container 122 rests on the tilted substantially round rotating support/ejector plate 84 in position under a final exit chute. When the container is filled the plate 84 rotates automatically by the force of gravity one quarter turn to position the filled container 122 against the container stop plate 132 at the container removal point by each end of the fender of the trailer 112 or in a like position on a floor mounted unit. Swing out or folding adjustable seats 78 are provided because the low final exit chutes 72L & 72R design makes no provision for standing operators.

Either hopper chute 28L or 28R section of the dual chute hopper 24 may be closed off by folding down its respective flip-flop plate 32 to prevent filling material from being fed through a selected chute 28L or 28R, thus converting the dual operator apparatus into a single operator machine without the use of tools.

Figure 2:
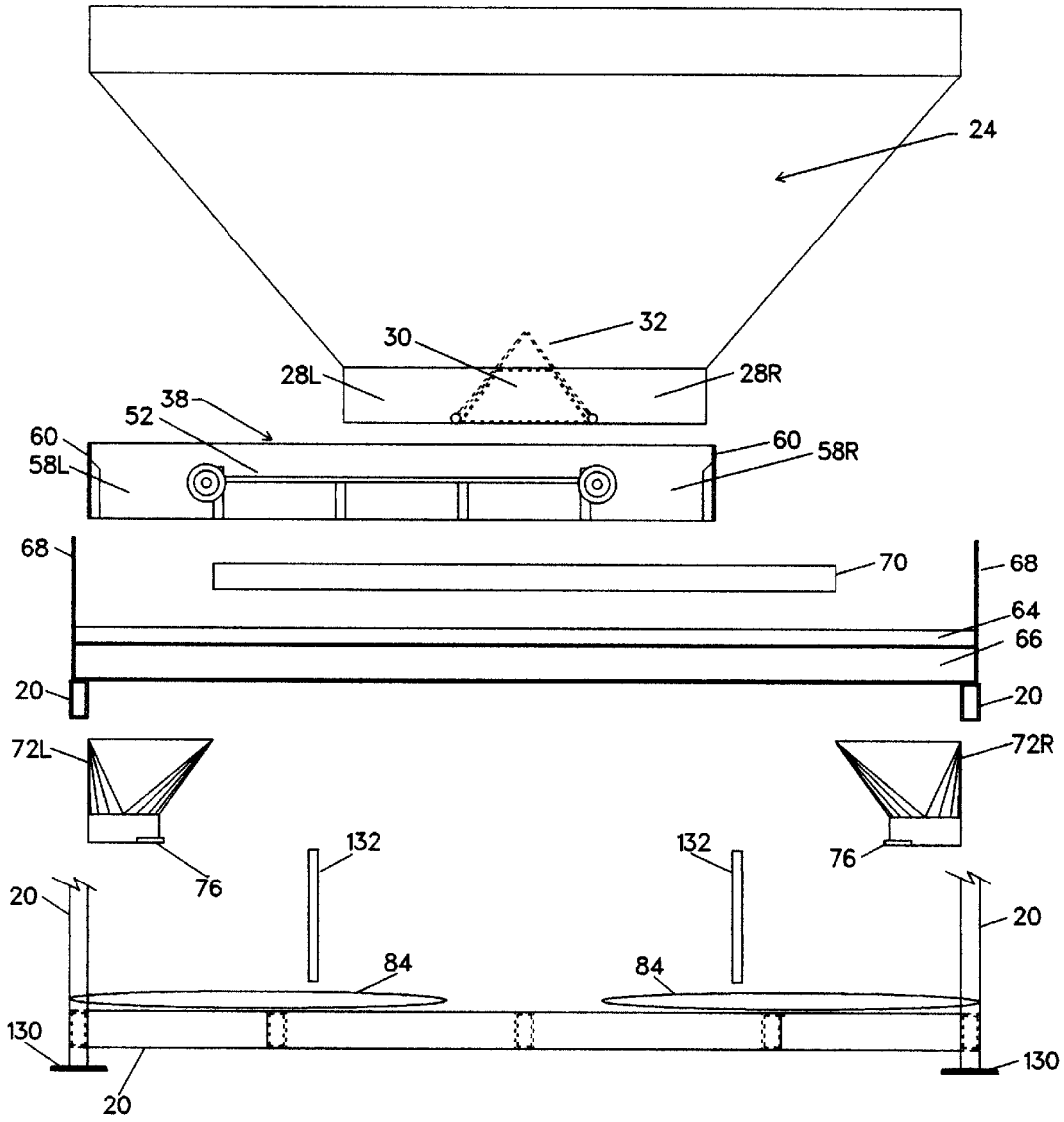
FIG. 2 is a front exploded view of the alternate embodiment floor mounted machine.

Referring now to FIG. 2, the invention is shown in exploded front view to illustrate the principle parts of the apparatus. The upper dual chute hopper 24 is configured with two hopper chutes, left 28L and right 28R. Two movable flip-flop plates 32 are attached to a center chute divider section 30. This hopper is suspended by frame 20 and sits just above the rolling drawer assembly 38 to which are connected 4 V-groove wheels 62. These wheels ride on an inverted V angle iron track 64 supported by I-beams 66, which are in turn connected to the lateral braces at each end of the frame 20. The end safety plates 60 of the drawer assembly and the stop plates 68 at each end of the I-beams 66 are removable to facilitate removal of the drawer. The frame 20 suspends the dual chute hopper 24 down into and slightly below the lip of the rolling drawer assembly 38. At each end of the rolling drawer assembly 38 is a flow-through compartment, the left 58L and the right 58R. A lower friction pan 70 sits inside of, and is constrained by, the double I-beams 66 and is supported by its flanges. The bottom of the rolling drawer assembly assembly 38 moves back and forth just under the dual hopper chutes 28L & 28R and just above the lower friction pan 70 and both exit chutes 72L & 72R. The rotating tilted bag support/ejector plates 84 support the containers or sandbags. Floor mount pads 130 are shown as in the alternate embodiment of the floor mounted unit.

Figure 3:
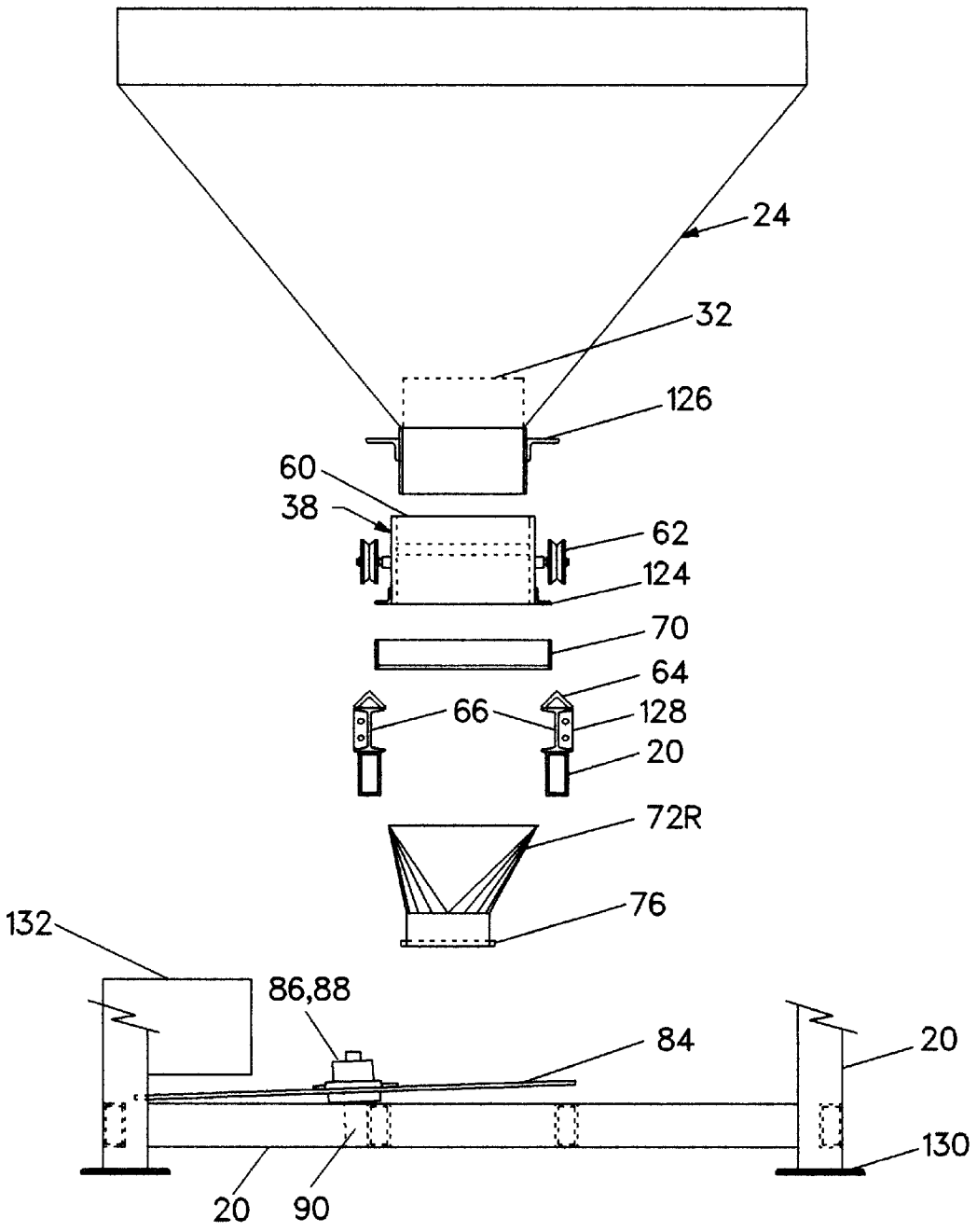
FIG. 3 is an end exploded view of the alternate embodiment floor mounted machine.

Referring now to FIG. 3, an exploded end view of the apparatus, showing the dual chute hopper, the rolling drawer assembly assembly 38, the lower friction pan 70, the inverted-V angle iron tracks 64 and their I-beam supports 66. The right end exit chute 72R and its lug bar 76 are shown off-set toward the front of the apparatus which is to the left of the viewer as seen from this end, to the right of the viewer if seen from the other end. On the part of the frame 20 shown at the bottom are the floor mounting pads 130, the rotating tilted bag support/ejector plate 84 supported by angled bearing post 90 with its top bearing 86 and bearing cover 88 attached to frame 20. Positioned above frame 20 and the rotating support/ejector plate 84 is the bag stop plate 132. A safety stop plate mount 128 is welded inside the outer flanges of the I-beam support 66 and drawer lift preventers 124 are shown attached to the drawer assembly. Track cover mounts 126 shown are attached to the bottom of the upper hopper assembly 24. Covers (not shown) to protect the track from spilled filling material are mounted here.

Figure 4:
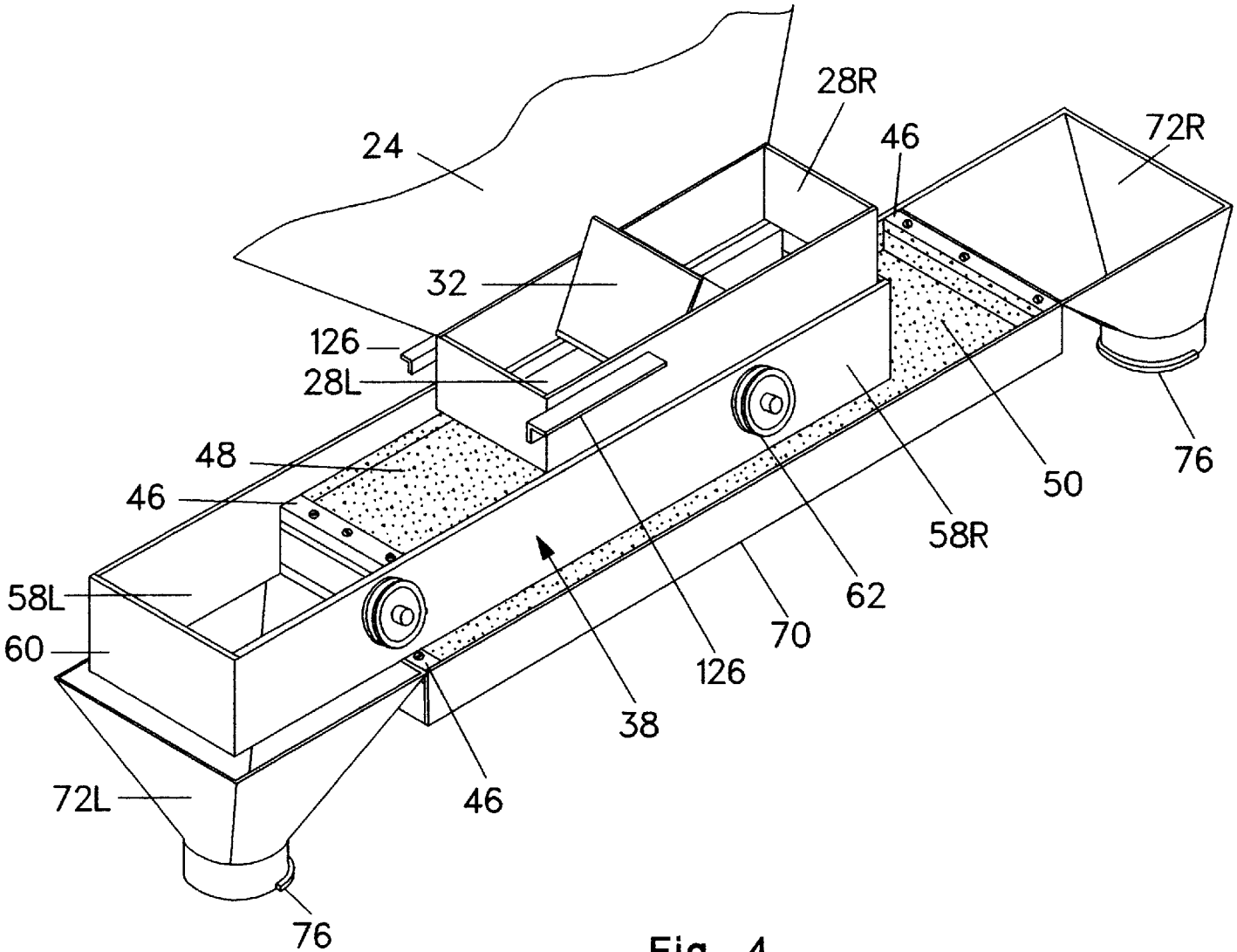
FIG. 4 is an isometric view of the filling apparatus and features.

Referring now to FIG. 4, the principal parts of the invention are shown in isometric view. The four side wall panels of the upper dual chute hopper 24 are represented by only the partial back panel in order to view a flip-flop plate and dual chute hopper. Only one of the hinged flip-flop plates 32 is shown, resting in its substantially upright position against the center chute partition 30 of the dual chute hopper's chute section. The left hopper chute 28L and the right hopper chute 28R allow the hopper's filling material to flow into and through either the left flow-through compartment 58L or the right flow-through compartment 58R of the drawer 38. Replaceable wear bars 46 are also at the bottoms of all rolling drawer assembly assembly partitions. In this figure, the left flow-through compartment 58L of the drawer 38 is positioned over the left exit chute 72L in position to drop any contained filling material through the left exit chute 72L and thus into an attached container. The right flow-through compartment 58R simultaneously is positioned under the right hopper chute 28R to be refilled with filling material in the right upper hopper chute 28R and the hopper above. The V-groove wheels 62 ride on the inverted V angle iron track (FIG. 2, 64) and (FIG. 3, 64) which track and wheels are protected from falling material by full length covers (not shown) attached to full length cover support flanges 126.

Figure 5:
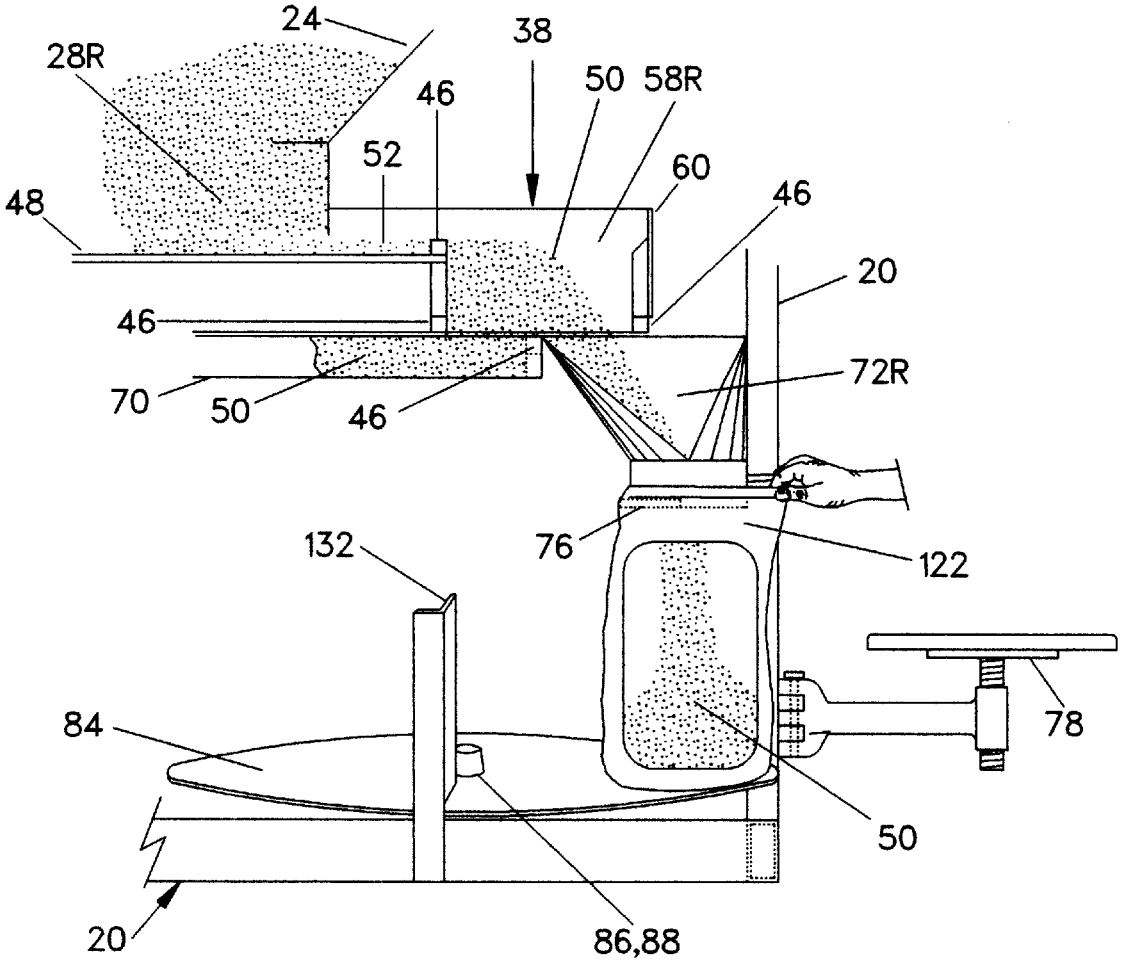
FIG. 5 is a front view of one half of the apparatus showing method of bag attachment and filling operation.

Referring now to FIG. 5, a front view of a container filling station. Sandbag 122 (as in the preferred embodiment) is shown attached over the back portion (from the operator) bag retaining lug bar 76 of the right exit chute 72R with tension applied by the operator's hand. The bag 122 is resting on the support/ejector plate 84. As illustrated, sand 50 or other material contained in the dual chute hopper's right hopper chute 28R is kept from falling through the open bottom of that chute by the similar material constrained in the upper friction pan 52 by the replaceable wear bars 46 and the center section cover plate 48. During operation the operator is seated on a folding or swing-out adjustable seat 78.

Figure 6:
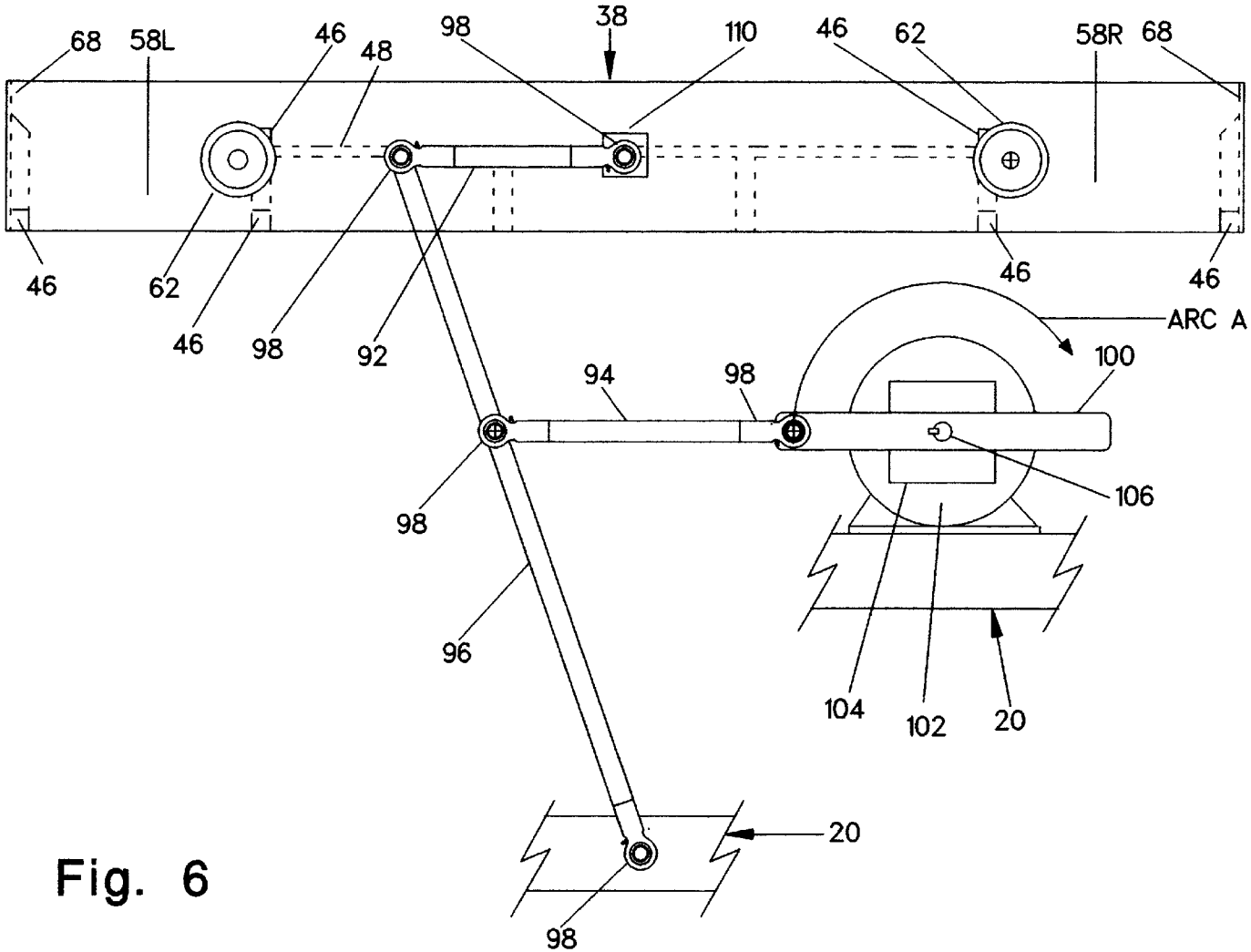
FIG. 6 is a front view of the drive mechanism.

Referring now to FIG. 6, the drive mechanism. The drive mechanism includes a commercially available electric motor 102 and gear reducer 104 supported in place and attached to frame 20, with the reducer shaft 106 keyed into a rotating drive bar or disc 100. The rotating drive bar or disc 100 is connected to the lower horizontal arm 94 which is connected to a pin on the substantially vertical lever arm 96 with a commercially available rod end bearing 98. The vertical lever arm 96 has a rod end bearing 98 at the bottom that is fixed to a pin on frame 20 at the bottom of the apparatus and with two pins higher up, the lower of which is the attachment point for the lower horizontal arm 94 and the top pin the attachment point for the upper horizontal arm 92. The upper horizontal arm 92 is connected at its other end with a rod end bearing 98 attached to a standoff block 110 and pin on the drawer assembly 38. Movement of a rotating drive bar or disc 100 of one half revolution about Arc A shown pulls the vertical lever bar 96 to the right with the lower horizontal arm 94 which consequentially pushes the drawer assembly 38 to the right with the upper horizontal arm 92 to its far right limit position.

Operation of Main Embodiment

The apparatus described relates to the filling of bags or other containers with sand or other materials with a dual operator machine. Its primary embodiment is to fill sandbags for the purposes of flood control, embankment support in road construction and repair, embankments for defensive support of military positions and for any other purpose wherein a large quantity of filled sandbags are required in a short period of time or with a minimum number of personnel. The apparatus described herein is illustrative of the use of the apparatus for the filling of sandbags but such description is not to be construed as restrictive or limiting in its function or purpose in any way. The invention also may be useful in filling many types of containers with feeds, fertilizers, chemicals and other granular or small particle materials.

The apparatus consists of a frame of rigid material capable of supporting a dual chute hopper with its maximum load of filling material and the machine. In its main embodiment it is mounted on a commercially available trailer or truck for portability and ease of deployment. In its alternate embodiment it is floor-mounted.

In operation the dual chute upper hopper 24 receives incoming sand from a positioned conveyor system, front-end loader or any other method for the transport of sand and stores same until that sand passes through one of the dual hopper chutes 28L & 28R and into the bag filling mechanism. The dual chute hopper configuration effectively allows the hopper 24 to be nearly double the capacity of a single chute hopper within the restrictions of the "angle of repose" requirements for bulk flow of material out of a bin or hopper. The "angle of repose" is that angle relative to level ground of the conical side slopes at which virtually any solid granular material will rest when piled up to some height by material falling onto the center point of its cone. The angles of all side wall panels of the dual chute hopper and both final exit chutes exceed the "angle of repose" of sand, thus ensuring better fall-out of the contained sand when the mechanism is positioned for that purpose. Attached to each side of the center chute partition 30 divider of the dual hopper chutes are hinged flip-flop plates 32, either of which may be lowered to close one of the hopper chutes to prevent sand or other material from falling through that chute and into the rolling drawer assembly 38, thus converting the apparatus from a dual to a single operator configuration until the flip-flop plate is returned to its substantially upright position and locked.

A reciprocating rolling drawer assembly 38 with side-mounted V-groove wheels 62 rolling on a dual inverted angle iron track 64 or other means of support and movement, receives a specific or adjusted variable amount of sand from the hopper 24 alternately into either of its two rechargeable flow-through compartments 58L & 58R which, during operation, continuously traverses in turn from one end of the machine to the other, alternately releasing the filling material contained within one of the two flow-through compartments of the rolling drawer assembly, down through its respective final exit chute 72L & 72R and into standard sandbags or other containers attached thereon or positioned under those chutes for filling by either of two operators. In so moving, the drawer assembly 38 simultaneously and automatically positions the opposing flow-through compartment under its respective upper hopper chute opening to be filled or refilled with a measured a mount of filling material for the next cycle as the drawer assembly reverses. The flow-through compartments of the drawer assembly and other applicable parts of the machine may be enlarged for variable bag or container capacities. Various size removable box shaped inserts also can be bolted to the inside of the side walls of the flow-through compartments to reduce temporarily the volume of those compartments, thereby reducing the volume and weight of sand or other materials falling into them from the upper dual chute hopper and thus finally into bags or other containers. The mechanism by which the drawer assembly moves back and forth could alternately be on linear bearings and shafts, on linear actuators, by hydraulic cylinders or other means of support and or movement. Drawer lift preventers 124 are mounted on the bottom of the drawer to prevent the drawer from bouncing off its track 64 during transport.

An upper friction pan 52 is an integral part of the center section of the drawer assembly which serves both to contain the filling material in the hopper chute immediately above the pan while one of its flow-through compartments is being emptied or repositioned, and to provide a large non-wearable surface in the drawer to move against the sand or other material contained in the hopper above. The end walls of the upper pan compartment of the rolling drawer assembly each are formed by replaceable bolted down wear bars 46 of abrasion resistant steel or other long wearing material which may be replaced easily in the field as they wear, thus giving a minimum wear area of surface subject to replacement due to the abrasive characteristics of sand or other materials.

Two final exit chutes 72L & 72R are utilized, one at each end of the machine, onto which a bag is held momentarily by either of the two operators until an automatic volume of fill material has fallen into the bag or other container. These chutes have no moving parts or gates but simply serve as a device both to attach a fresh bag to be filled and to funnel material from the flow-through compartments at either end of the drawer assembly into a pre-attached sandbag. Each chute has a bag retaining lug bar 76 attached to the bottom rear half of the chute's circumference as seen from each operator's position. This bar serves to hold the back seam of the sandbag being filled onto the exit chute. The bag to be filled is resting on a substantially circular revolving support ejection plate 84 so only a gentle grip is required to hold the bag on the chute against the friction of falling sand, not to support the bag as it fills. Thus the operator's other hand can reache for another empty sandbag in preparation for attaching and filling on the next return of the drawer assembly. Because of the gradual falling of sand into the exit chute even as the flow-through compartment of the drawer assembly just begins to move over that chute, the chutes can be made smaller in diameter than other similar machines for ease in attaching an empty sandbag over the lug bar and onto the chute.

Two dual function tilted rotating bag support/ejector plates 84 are mounted to the bottom frame. These substantially circular gravity powered plates support the sandbag or other container as it is being filled and then clear the workspace by automatically moving the filled bag or other container one-quarter of a circumference turn away from the operator's position so that he or she may attach and fill another container when the drawer assembly returns again to his or her chute with the next charge of fill material. The plates will stop rotating automatically when the filled bag has been moved to the proper position for removal against the container stop plate 132 and can then be removed and delivered to its place of final positioning.

A drive system consisting of a commercially available electric motor 102 and gear reducer 104, lever arms and bearings moves the drawer assembly toward first one operator's position and alternately to the other's, the various chambers of the drawer stopping at and reversing automatically from the proper position at each end of its travel limit is utilized. The gear reducer connected to a rotating drive bar 100 or disk that alternately pulls and pushes laterally the lower arm 94 which is connected to a substantially vertical lever arm 96 which simultaneously transfers this motion to the rolling drawer assembly. By this method the electric motor thus runs at a constant but adjustable speed and a constant direction without the reversing action of a hydraulic cylinder drive or requiring limit switches, sensors, relays and attendant complicated circuitry for electrical operation. A pin at the top of this vertical lever arm connects to a bearing of an upper horizontal arm 92 that is in turn connected by another bearing to the drawer assembly.

It is the natural mechanical action of this drive to start the drawer assembly moving relatively slowly, increase the speed of that movement and then slow it back down again as it nears the other end of the apparatus. Because of the synergistic effect of the dual chute hopper configuration, the rolling drawer assembly and the flow-through compartments therein, sand or other material from the upper hopper falls into and through a much larger rectangular flow-through compartment than if falling directly into and through a much smaller diameter exit chute without the intermediate function of the drawer assembly. The size and therefore the free flow rate of the exit chutes are dictated by the diameter of the opening in one end of the standard sandbag. Because the drawer assembly is slowing down as it begins to pass over the exit chute, sand begins to fall into that chute gradually, instead of all at once, and the efficiency of the sand flow is greatly increased. Because the drawer assembly also moves its flow-through compartments under their respective large rectangular hopper chutes as it is slowing, sand there also falls gradually instead of all at once and thus the efficiency of sand flow is increased there also. Sand falling from the hopper into the flow-through compartments of the drawer assembly falls into an area approximately three times the size of a typical sandbag filling chute's exit circumference, again increasing the efficiency of sand flow. While an electric motor, gear box and drive configuration is used in this apparatus, hydraulic cylinders or other means of positioning the drawer assembly are also usable, albeit with somewhat less speed of cycle and with additional complications and wear.

Depending on the manual dexterity of the two operators, the electric motor drive can be slowed or speeded with a commercially available rheostat, thereby giving a wide range of production rates. Each operator has easy access to a cut-off switch so that either may stop the rolling drawer assembly immediately if necessary.

Operators at both ends of the apparatus are seated and their surrounding area is not cluttered. Sand or other material is fed into the upper dual chute hopper by conveyor, front end loader or other means from the back side of the apparatus while filled bags are being removed from the front. No one is bent over or crowded in between other workers or experiencing pain or fatigue from the stooping or squatting. Strength is not a requirement for the operators and operator fatigue is minimal.

Folding or swing-out seats 78 are attached at each end of the machine for the comfort and ease of operation by the personnel filling the bags. Multiple safety stops to prevent the drawer assembly from exiting either end of the track and injuring personnel are an integral part of the apparatus.

In the main embodiment operation the machine is transported to and positioned at the planned location, braced using the outboard support jacks on the commercially available trailer structure, and an initial charge of sand is loaded into the twin chute hopper. Two operators, one at each end, are seated with a supply of empty bags within their reach and each operator attaches a sandbag to be filled onto the exit chute at his/her respective position by fitting the top of the sandbag over the bag lugs and pulling on the seam with one hand. The machine is turned on. After the first one or two cycles both friction pans are full of sand and each operator's unfilled bag can be temporarily discarded. On about the second or third cycle both pans will be full and each operator will receive a full charge of sand into his or her chute. By holding a bag onto the rear lug bar with only one hand until sand falls into it each operator can be reaching to the side with the other hand to grasp another bag by the top hem ready to slip it onto the chute. As soon as the operator feels the sand fall and the drawer assembly starts to move away from that end position he or she simply releases the filled bag on the chute. By force of gravity of a heavy bag on a tilted rotating container support/ejector plate the plate will start to rotate. As soon as it rotates the just filled bag out of the way, that operator is free to secure the next bag over the chute's lug bar by pulling gently on it while reaching for yet another with his/her other hand.

By this time, the just filled bag has reached the low point of the ejector plate's travel, that bag has hit the bag stop plate, another worker is removing it and the drawer assembly has reached the other end of its travel, filling that other operator's positioned bag while simultaneously refilling the near operator's flow-through compartment with another measured charge of sand as it stops in the proper position under the near hopper chute. This alternating dumping of sand into one exit chute while filling the other end's flow-through compartment is due to a constantly reversing drawer assembly powered by a continuously rotating motor. The linkage of this motor to the lever and horizontal arms allows the motor to continuously rotate in one direction without constantly stopping, reversing, and starting again and transfers the continuous rotary motion of the motor into reciprocating travel of the drawer assembly. The limits of the linkage travel also prevent the drawer from stopping anywhere except at the proper position. The drawer assembly's flow-through compartments and the exit chutes all receive their charge of falling sand while the drawer assembly is slowing down and stopping thereby allowing a longer time for the material to drop. Additionally, each of these compartments begins gradually receiving their charge of sand as the edge of those compartments just begins moving under or over their designed position.

With generator, other electrical power or by hydraulic system, the rolling drawer assembly is moved to the left end of the machine (for example.) When that position is reached, sand in the upper hopper 24 can fall from the rightmost (front view FIG. 1) rectangular hopper chute 28R into the right end flow-through compartment 58R of the rolling drawer assembly. However, because a portion of the lower friction pan 70 is directly under right flow-through compartment of the rolling drawer assembly in this position, the sand is contained in the right end flow-through compartment. The rolling drawer assembly then moves automatically to the right and over the edge of the lower friction pan 70 at the right end of the machine. As a consequence of this movement it rolls the right sand-filled flow-through compartment over the machine's right end exit chute 72R and its newly positioned empty sandbag underneath. As the right end sand-filled flow-through compartment barely begins to move over the right end exit chute, the sand in that flow-through compartment is no longer constrained in that compartment by the lower friction pan. Thus the sand is then free to fall as each area of that compartment rolls over the edge of the right exit chute, as opposed to falling all at once and causing jamming of sand in the chute.

With that same movement, the rolling drawer assembly is also moving the sand receiving flow-through compartment 58L at the left end of the rolling drawer assembly into a position under the left rectangular hopper chute. Now, that compartment is positioned to receive a charge of sand which will fall, beginning even as the first part of that compartment moves under the left rectangular hopper chute 28L, and while sand is falling from the right end flow-through compartment into the right end exit chute. On a timed continuous cycle, the drawer reverses automatically to drop the left flow-through compartment's 58L sand into the left exit chute 72L and its attached empty sandbag, while simultaneously bringing the now empty right end flow-through compartment 58R of the rolling drawer assembly into position under the right hopper chute 28R for filling with a new charge of sand, ready to return again automatically to the right end to dump into yet another, newly placed sandbag.

As the bags at each end are filled alternately, the filled bag at either end, which was resting on the rotating support/ejector plate 84 in preparation for filling, is now rotated around one quarter turn by gravity and stops automatically at a position by the fender of the trailer for removal, or at the same position exit point for the floor mounted machine. There, other workers can remove them easily to be tied or sealed and transported to their area of placement or palletized for later shipment.

Bag filling operators at each end of the machine are seated for comfort and ease of work. The operators' and the machine's output can easily outpace the delivery of sand to the upper hopper so that the principal limiting factor of production will be the delivery of sand to the operating location, particularly if the sand is coming from a source some distance away.

In operation, the bags need be held onto the exit chutes at each end of the machine only momentarily, until all of that bag's intended charge of sand has been dumped into the sandbag. This is facilitated by a protruding lug bar 76 around the back (from each operator's position) of each exit chute which wraps around approximately 50% of each chute's circumference. The operators simply slide the opened sandbag up and over the rear lug bar and then pull gently on their nearest part of the sandbag, thus enabling a tightening of the bag over the lug bar. The combination of the lug bar holding up the back of the bag and an operator's single hand holding up the front of the bag keeps the bag in position to be filled without spillage. This one handed action thus frees the operator's other hand to reach for a replacement bag to be filled on the next cycle of the rolling drawer assembly, even as the bag on the exit chute is filling. Holding the bag onto the exit chute requires very little effort as there is only the friction of the falling sand, not its weight, to pull the bag down and off the exit chute. There is virtually no weight pulling the bag down or off the exit chute because the bottom of the bag with its increasing charge of sand is fully supported by the rotating support/ejector disk underneath it.

The rotating support/ejector disks 84 are each tilted down toward the front of the machine in the range of 2 to 4 degrees. Gravity and the weight of a standard filled bag of sand will start the disk rotating around toward the lowest part of the disk, the point of removal by another worker. When the filled bag reaches the lowest point of the tilted disk's circumference it is stopped by a container stop plate 132 attached to the frame. Even without the stop plate the laws of gravity would prevent that bag from "climbing the hill" up the other side and, therefore, the rotating disk will stop with the newly filled sandbag well within reach of the worker removing the filled sandbag.

As the filled sandbag on the rotating bag support/ejector starts to move away from each filling operator's position, that operator is then able to attach another bag already in his other hand in anticipation of the return of the rolling drawer assembly with another charge of sand. With very little effort on the part of either operator, maximum production, within the limits of sand delivery to the site, can be attained easily.

The upper dual chute hopper's flip-flop plates 32 will prevent sand or other material from falling into one of the flow-through compartments and thus feeding the de-selected exit chute. This will enable the machine to function with only one filling operator instead of requiring two. Either plate may be used to close its respective part of the upper hopper.

Description and Operation (Alternative Embodiments)

An alternative embodiment would be a normally non-portable, floor mounted unit. This apparatus differs only in the base. Floor plates of sufficient thickness welded onto the bottom of the upright supports would be bolted into a floor for safety and the vertical legs would be several inches longer. In all other phases of operation and construction it is the same as the preferred embodiment. It performs and produces in the same way with the same power requirements and arrangements. With this embodiment volunteers could fill, palletize and store bags in anticipation of future need while under a shed or in a warehouse. Then, large quantities of palletized filled sandbags (in the case of use for that purpose) would be available as quickly as they could be transported to a site of use or urgent need. When used for packaging other types of materials a warehouse or factory would normally not require portability.

The trailer or truck mounted unit could, of course, be operated under the protection of a shed or warehouse also. The floor mounted unit also could be used as a portable by unbolting the base from the floor and loading the machine onto a truck or trailer for transport to a distant site.

Conclusions, Ramifications and Scope

I have presented herein design for a simplified and improved apparatus over the prior art. It is a sturdy, easy to operate, convenient and easily maintained apparatus which corrects many of the faults of previous designs with an emphasis on speed and safety. Because of the design and method operators can produce faster and with less fatigue, allowing greater production for a longer period of time.

The apparatus dimensions could be varied widely to accommodate the filling of vaarious containers with many other materials, generally dry and granular. Dimensions of the sandbag filling embodiment are for a volume to fill a standard sandbag to an average practical weight. Oversize flow-through compartments and mating portions of the apparatus could be utilized, then a portion of those compartments effectively reduced in size and volume with bolt-in blocks of various cubic volumes when needed, making it useful for almost any kind of reasonably dry granular materials. Construction of critical parts with certain food grade stainless steels would allow also packaging of many granular and powdered food products.

What is claimed is:

1. An apparatus and system for filling bags or other containers with a pre-determined quantity of sand or other filling material, consisting of:

a frame assembly of rigid material;

a dual chute hopper for receiving and storage of filling material with two lower located and separated left and right hopper chutes optionally with dual hinged flip-flop plates attached to a center chute partition allowing either plate to be positioned to close either hopper chute in said hopper, thereby changing said apparatus from a dual operator to a single operator configuration;

two final exit chutes, one at each of two ends of the apparatus, rectangular at the top where it is affixed to said frame assembly, and transiting to a substantially round cross section exit of sufficient size to discharge filling material into bags or to direct filling material into other containers, said chute having a projecting bag retaining lug bar attached to substantially half of each exit chute with a circumference opposite an operator position, against and above which bottom supported bags may be held by tension of one hand pulling of the bag while filling;

two substantially round rotating support/ejector plates located under and separated from each exit chute, each attached by a centered bearing on a shaft mounted to said frame assembly at an angle of several degrees down toward a front portion of said frame assembly upon which a bag or other container rests while being filled and which, upon release of said bag or other container by an operator, will by force of gravity revolve a bag or other container approximately one quarter turn of said plates to a position against a container stop plate, from which position it may be removed while another bag or container is being filled;

a plurality of field removable wear bars in strategic positions which may be replaced easily with simple tools whenever wear at these points becomes objectionable;

a rolling drawer assembly consisting of a rectangular box constraining three sections, each end section being a four-sided, open top and bottom flow-through compartment sized appropriately for a volume of filling material to be used, said center section being substantially equivalent in length to three end sections and supporting a recessed solid plate bounded at each end by replaceable wear bars, which holds a portion of said filling material and forms a barrier to prevent filling material from discharging from said hopper chutes when said center section is under said chutes and which forms an upper friction pan, a non-wearable surface containing a portion of like filling material against which filling material contained in either of said chute hoppers may slide, said rolling drawer assembly to be suspended by v-groove wheels on inverted angle iron track or by linear bearings, allowing said rolling drawer assembly to move reciprocally from one end of said apparatus to the other so that when said right flow-through compartment is positioned over the right exit chute for dumping the left flow-through compartment simultaneously is positioned under said left hopper chute for filling and, conversely, when said left flow-through compartment is positioned over said left exit chute discharging its load said right flow-through compartment is positioned under said right hopper chute for reloading;

a lower friction pan, a shallow rectangular affixed to rigid frame members under and adjacent to the underside of said rolling drawer assembly and placed longitudinally between and adjacent to said two exit chutes, which contains a quantity of like filling material to also serve as another non-wearable surface which prevents filling material from flowing through filled flow-through compartments until said compartments move from said surface to a position over an exit chute;

adjustable seating attached to the rigid frame assembly and positioned so as to place each operator directly before an exit chute and a rotating support/ejector plate so as to facilitate easy and least effort access to bags or other containers and easy and least effort clearing of an operator's work area in anticipation of attaching another bag;

whereby either one or two operators, while seated comfortably at a spacious work station and without regard to their physical strength, may rapidly, easily and continuously fill bags or other containers with specific amounts and weights of granular material and operators or others may replace easily important wear surfaces of a simplified mechanically and electrically operated apparatus.

2. The apparatus and system in claim 1, further comprising:

an electric motor and gear reducer in combination with, a rotating bar, plate and disc affixed to said motor and gear reducer, a reciprocating arm attached thereto and to a substantially vertical lever arm with a bottom rod-end bearing affixed to said frame assembly and another reciprocating arm attached at one end to the top of the lever arm and on the other end to the side of said rolling drawer assembly, said motor and gear reducer fitted with a variable speed control, the whole of which will convert a continuously rotating electric motor drive into a variable speed, reciprocal motion drive of said rolling drawer assembly, moving it from one end of said apparatus to the other at an adjustably timed rate, alternately filling said flow-through compartments of said rolling drawer assembly and subsequently discharging those contents into final exit chutes at opposing ends, both actions beginning and continuing while said rolling drawer assembly is still rolling so that a gradual flow of filling material is presented both to said flow-through compartments and to said exit chutes even while still rolling thereby reducing or eliminating jamming of filling material and with start/stop means and rheostat adjustments disposed within reach of each operator's position;

a means of generating electrical current for operation as a mobile unit with provision for use of generally available electrical current when used in a semi-permanent or permanent location.

3. A configuration of construction of the apparatus and system in claim 1 whereby:

said apparatus may be mounted for transport to various sites for mobile operation or permanently mounted to leg extensions and pads and bolted into a permanent floor for fixed operation;

removable box shaped inserts of various sizes may be attached to side walls of said flow-through compartments to temporarily or permanently reduce the volume and therefore weight of filling material transiting said flow-through compartments to containers placed under said exit chutes;

the center section of said movable distribution unit being approximately and at least a distance of three times the longitudinal distance of a single flow-through compartment to prevent filling material from flowing into or through said compartments until said compartments are properly positioned for either filling or discharge;

both lower exit chutes are offset toward the front of the apparatus to better position the bags and other containers on the maximum amount of the rotating support/ejector plate for maximum support.

* * * * *